US010232637B2

(12) United States Patent
Schiestl

(10) Patent No.: US 10,232,637 B2
(45) Date of Patent: Mar. 19, 2019

(54) DEVICE AND METHOD FOR PRINTING TEXTILE SURFACES

(71) Applicant: Aeoon Technologies GmbH, Kramsach (AT)

(72) Inventor: Angelo Schiestl, Langkampfen (AT)

(73) Assignee: Aeoon Technologies GmbH, Kramsach (AT)

( * ) Notice: Subject to any disclaimer, the term of this patent is extended or adjusted under 35 U.S.C. 154(b) by 0 days.

(21) Appl. No.: 15/746,301

(22) PCT Filed: Jul. 20, 2016

(86) PCT No.: PCT/EP2016/067272
§ 371 (c)(1),
(2) Date: Jan. 19, 2018

(87) PCT Pub. No.: WO2017/013166
PCT Pub. Date: Jan. 26, 2017

(65) Prior Publication Data

US 2018/0215171 A1 Aug. 2, 2018

(30) Foreign Application Priority Data

Jul. 20, 2015 (EP) ..... 15177435

(51) Int. Cl.
*B41J 3/407* (2006.01)
*B41J 11/14* (2006.01)
(Continued)

(52) U.S. Cl.
CPC ..... *B41J 3/4078* (2013.01); *B41J 11/06* (2013.01); *B41J 11/14* (2013.01); *D06P 5/30* (2013.01)

(58) Field of Classification Search
CPC ..... B41J 3/4078; B41J 11/06; B41J 11/14
See application file for complete search history.

(56) References Cited

U.S. PATENT DOCUMENTS 6,059,391 A * 5/2000 Fulkerson ..... B41J 3/28 101/44
8,177,442 B2 * 5/2012 Abbott ..... B41J 11/02 400/48

(Continued)

FOREIGN PATENT DOCUMENTS

EP 1 740 388 A2 1/2007

OTHER PUBLICATIONS

International Search Report and Written Opinion dated Jan. 26, 2017 for PCT/EP2016/067272.

(Continued)

*Primary Examiner* — Jason S Uhlenhake
(74) *Attorney, Agent, or Firm* — Dinsmore & Shohl LLP

(57) ABSTRACT

The invention relates to an apparatus for printing textile surfaces, comprising a first printing device (10) which is movable in a longitudinal direction along a longitudinal axis of the apparatus, wherein the printing device has a print head (51, 52) by means of which at least one textile can be printed with at least one printing ink, at least two pallets (21, 24) for receiving and holding the textile to be printed, a first set-up station (20) which is arranged on a first long side for feeding the textile and attaching the textile to the pallet (21, 24), at least one second set-up station (30) which is arranged on a second long side opposite the first long side, a first moving device (23) by which the at least one of the pallets is movable on a first track (41) transversely with respect to the longitudinal axis between a first lateral set-up position (20) on the first set-up station and a first printing position on the printing device, and at least one second moving device (26) by which at least one more of the pallets is movable on an at least second track (43) transversely with respect to the longitudinal axis between at least one second lateral set-up (Continued)

Figure 1:
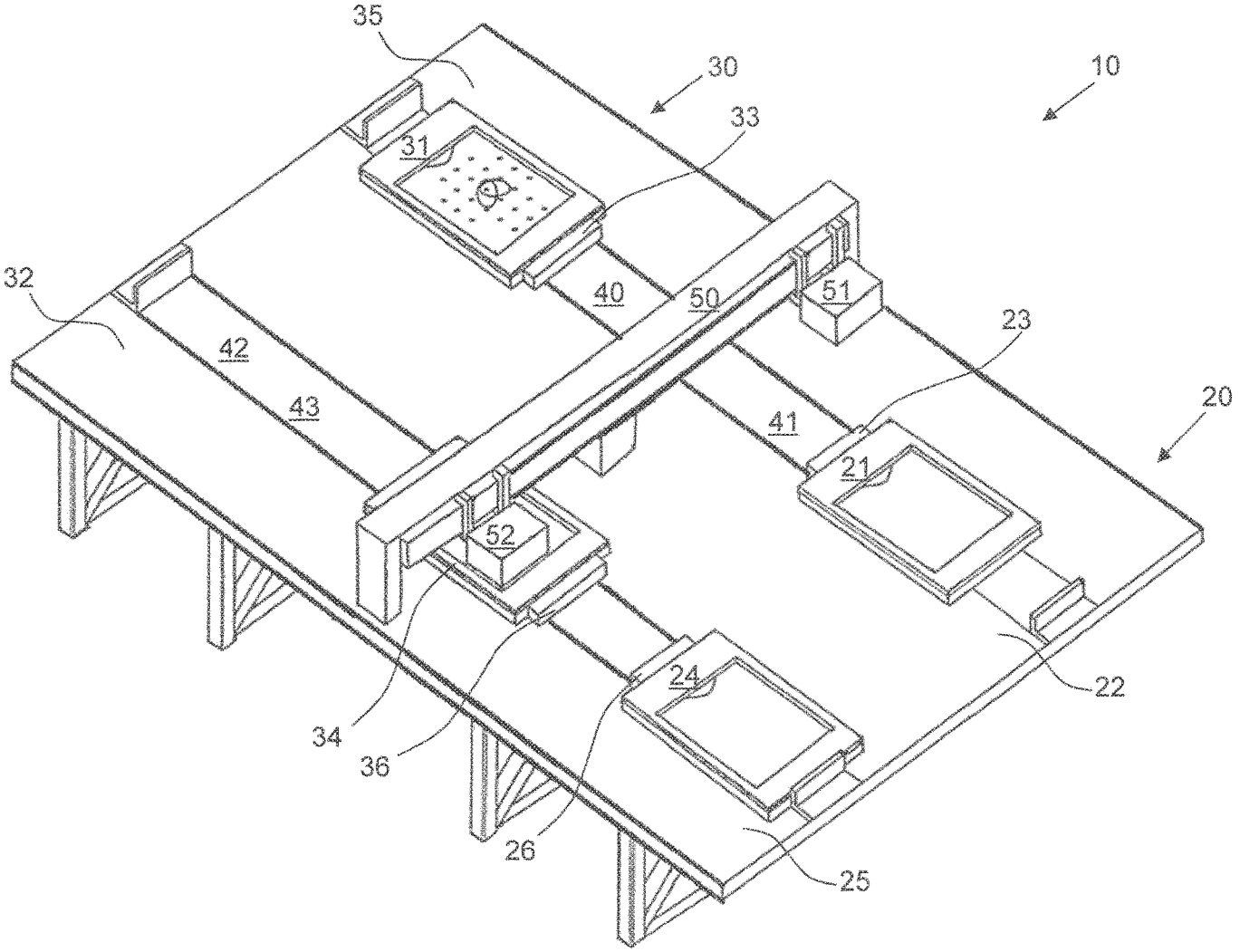

position (32) on the at least second set-up station (30) and at least one second printing position.

12 Claims, 3 Drawing Sheets

(51) Int. Cl.
*B41J 11/06* (2006.01)
*D06P 5/30* (2006.01)

(56) References Cited

U.S. PATENT DOCUMENTS

2005/0179708 A1 8/2005 Ben-zur
2007/0103529 A1* 5/2007 Pearl ..... B41J 3/28
347/101

OTHER PUBLICATIONS

European Search Report dated Jan. 21, 2016 relating to EP Patent Application No. 15177435.3.

* cited by examiner

DEVICE AND METHOD FOR PRINTING TEXTILE SURFACES

The invention relates to a device for printing textile surfaces in accordance with the preamble of claim 1.

A device of such type has at least one first printing means which can be moved along a longitudinal axis of the device in a longitudinal direction, wherein the printing means has a print head, by means of which at least one textile can be printed with at least one printing ink, at least two pallets for accommodating and holding the textile to be printed, a first set-up station which is arranged on a first longitudinal side for supplying the textile and placing it on the pallet, at least one second set-up station which is arranged on a second longitudinal side lying opposite the first longitudinal side, a first movement means, with which the at least one of the pallets can be moved on a first track in a direction transverse to the longitudinal axis between a first lateral set-up position at the first set-up station and a first printing position at the printing means, and at least one second movement means, with which at least a further one of the pallets can be moved on at least one second track in a direction transverse to the longitudinal axis between at least one second lateral set-up position at the at least second set-up station and at least one second printing position.

Furthermore, such a printing device has a printing means which can be moved along a longitudinal axis of the device in a longitudinal direction, wherein the printing means has a print head, by means of which at least one textile can be printed with at least one printing ink, at least one pallet for accommodating and holding the textile to be printed, a set-up station which is arranged on a first longitudinal side for supplying the textile and placing it on the pallet, and at least one movement means, with which the at least one pallet can be moved in a direction transverse to the longitudinal axis between a first lateral set-up position at the set-up station and a printing position at the printing means.

Furthermore, the invention relates to a method for printing textile surfaces in accordance with the preamble of claim 7.

In a method of such type at least one textile is accommodated and held on at least one pallet, wherein the at least one pallet is located at a first set-up station in a first lateral set-up position on a first longitudinal side, the at least one textile is moved by means of a first movement means on a first track between the first lateral set-up position at the first set-up station and a printing position at a printing means, the at least one textile is printed in the printing position by the printing means by means of at least one print head which is moved along a longitudinal axis, and by means of the first movement means the printed textile is moved from the printing position into the first lateral set-up position at the set-up station for removal, wherein at least one further textile is accommodated and held on at least one further pallet which is located in a second lateral set-up position at a second set-up station on a second longitudinal side lying opposite the first longitudinal side, wherein the at least one further textile is moved by means of at least one second movement means on at least one second track between the second lateral set-up position at the second set-up station and the printing position at the printing means, wherein the at least one further textile is printed in the printing position by the printing means and wherein the at least one further textile is moved from the printing position into the second lateral set-up position at the second set-up station for removal.

Furthermore, the invention relates to a method for printing textile surfaces in accordance with the preamble of claim 7.

Furthermore, in such a method at least one textile is accommodated and held on at least one pallet, wherein the at least one pallet is located at a set-up station in a first lateral set-up position on a first longitudinal side, the at least one textile is moved by means of a movement means between the first lateral set-up position at the set-up station and a printing position at a printing means, the at least one textile is printed in the printing position by the printing means by means of at least one print head which is moved along a longitudinal axis, and by means of the movement means the printed textile is moved from the printing position into the first lateral set-up position at the set-up station for removal.

A generic device and a corresponding method for printing textile surfaces is known from EP 1 740 388 A2 for example. In this device and the corresponding method a pallet can be loaded with a textile, wherein the pallet can be delivered on a track to a printing means. The printing means has at least one digital print head and is movably supported along a longitudinal axis, which is designed transversely to the movement direction of the pallet, in a longitudinal direction on a longitudinal suspension.

In the case of such a device the pallet is normally loaded with a textile in a first position along the track and is subsequently delivered on a guide rail to the printing means for printing the textile in a second position. During loading with a textile or movement of the pallet between the positions the printing means is not in printing operation until the loaded pallet has been delivered to the printing means. Once the pallet with the textile has been delivered to the printing means, it is not possible for a staff member to make any further preparations for a subsequent printing cycle, i.e. the printing of further textiles along the same track.

The provision of several such devices that are arranged in parallel next to each other, each having one pallet and one guide rail, on which the pallet can be moved, can only increase the efficiency of the staff member who operates the device but not the efficiency of the printing means itself.

The present invention is based on the object to provide a device for printing textile surfaces and a corresponding method which render it possible to reduce the idle time between individual printing cycles and thereby considerably increase the efficiency of such a printing device.

In accordance with the invention the object is achieved on the one hand by a device having the features according to claim 1 and on the other hand by a method having the features according to claim 7.

Advantageous embodiments are stated in the dependent claims, the description and the Figures.

The device according to the invention for printing textile surfaces is characterized in that at least one second printing means is provided, wherein the first printing means and the least second printing means can be moved independently of each other in the longitudinal direction, and in that at least one of the printing means can be moved to the first printing position on the first track and to the second printing position on the at least second track.

Furthermore, the method according to the invention for printing a textile surface is characterized in that at least one second printing means is provided, wherein the first printing means and the at least second printing means are moved independently of each other in the longitudinal direction, and in that at least one of the printing means can be moved to the first printing position on the first track and to the second printing position on the at least second track.

A fundamental idea of the invention resides in the fact that more than one set-up station is arranged on a device for printing textile surfaces so that textiles can be delivered from several sides to the printing means. The time between two printing cycles is reduced in that while a textile is being provided in one set-up station, a further textile from an opposite set-up station is already being delivered from another side to the printing means. The idle time of the printing means, i.e. the time, in which no textile is being printed by the printing means, is thus reduced due to the shorter time interval between conveying a printed textile away from the joint printing position into a set-up station and supplying a textile to be printed from a further set-up station to the joint printing position.

According to a preferred embodiment of the invention provision is made in that at least the print heads of the first printing means and the second printing means are designed to print at least both the textile on the first pallet as well as on the second pallet. Hence, by means of each of the printing means both a textile on a pallet on a first track and a textile on a pallet on a second track can be printed by the same printing means. By preference, a control means can be provided which is connected to the printing means and/or the movement means and is designed to actuate the individual printing means or rather their print heads for effective printing and/or to control by means of the movement means of the respective pallets a position of the pallets that is suitable for printing, in particular at the printing position. Basically, the printing means can be designed to jointly print individual or also several textiles arranged next to each other on different tracks. This ensures an effective use of the printing means.

In particular, a first printing means can be designed with print heads that can dispense a first ink, especially a primer ink or a pretreatment liquid, while the second printing means is designed with print heads that can dispense a printing ink. In this way, for example, one textile or several textiles on tracks located next to each other can be pretreated/primed by means of the first printing means, while the second printing means is designed to print the pretreated/primed textile.

Thus, a printing device can be created which has any desired number of means arranged next to each other for holding and moving textiles, not however having an equivalent number of printing means but, compared to the number of tracks, having a reduced number of printing means which can be delivered to each of the printing positions on the corresponding tracks.

It is also conceivable that several printing means have printing ink, allowing them to print one textile or several textiles on one or several pallets in a simultaneous fashion, i.e. with a higher overall speed.

By preference, on the tracks one further pallet can be arranged in each case, wherein one of the pallets on the respective tracks is in each case assigned to the first set-up station or the second set-up station.

It is particularly preferred that on the tracks one further pallet can be provided in each case, wherein one of the pallets on the respective tracks is in each case assigned to the first set-up station or the second set-up station.

According to the invention the printing positions are to be understood as the respective area, in which the printing means and a textile delivered to the printing position enable a printing of the textile. In particular, for a pair of pallets of each track a joint printing position is provided. This can, in particular, be the area in which the nozzles of the print head or the print heads of the printing means are located above the textile.

Basically, any desired number of tracks with at least one pallet, especially two pallets can be provided in parallel next to each other. Preferably, two, three, four, five or more tracks are arranged next to each other. These can each be reached by the printing means, in particular through longitudinal movement of the printing means. Provision can be made for one, two, three or more printing means which can print the textiles on the pallets in the described coordinated and cooperating manner.

The printing means can be arranged both on the same side and on different sides of a guide means, in particular having the shape of a longitudinal beam.

By preference, at least one second set-up station can be provided which is arranged on a second longitudinal side lying opposite the first longitudinal side.

By particular preference, at least one further textile can be accommodated and held on at least one further pallet which is located in a second lateral set-up position at a second set-up station on a second longitudinal side lying opposite the first longitudinal side, the at least one further textile is moved by means of a further movement means between the second lateral set-up position at the second set-up station and the printing position at the printing means, the at least one further textile is printed in the printing position by the printing means and the at least one further textile is moved from the printing position into the second lateral set-up position at the second set-up station for removal.

According to a further development of the invention it is preferred that at least one further pallet is arranged for accommodating and holding a further textile to be printed, which can be moved by means of at least one further movement means between a second lateral set-up position at the second set-up station and the printing position at the printing means. Such a further pallet in the second set-up station can be loaded with textile for printing whereas by means of the printing means a textile can be printed in the printing position.

Furthermore, it is preferred that the pallets are arranged in pairs opposite each other along the two longitudinal sides. A pairwise arrangement of the at least two pallets can make it possible that more than one pallet is delivered successively from different sides to the joint printing position at the printing means. Thus, the joint printing position of the printing means can be used in an especially efficient manner. The pairwise arrangement of the opposite pallets can in particular be provided in a direction transverse to the longitudinal axis.

According to a further development of the invention it is particularly preferred that the opposite pallets can be moved along a joint axis between their set-up positions in their respective set-up stations and the printing position. On the one hand, this can enable the alternating operation of the device according to the invention, in which the pallets arranged in pairs can be delivered on a joint guide rail from their opposite set-up positions to the printing position. However, it is also conceivable that the pallets can be led through the device in a linear mode, in which a pallet can be loaded with a textile in a first set-up position at a first set-up station, the pallet can be delivered along the guide rail to the printing means and, on completion of printing, the pallet with the printed textile can be moved into the second set-up position at the second set-up station for removal. For such a mode of operation pallets can e.g. be designed such that they can be removed in a particularly easy way from the guide rail in the second set-up station. This can be rendered possible e.g. by a locking system, by means of which the pallets can be reversibly locked on the guide rail.

An expedient further development of the invention can reside in the fact that one pallet of the opposite pallets can be loaded with a textile in the set-up position while the other pallet is supported in the printing position. The provision of several opposite pallets that can be conveyed to the joint printing position can bring about a reduction of the idle times which can result in an increase in the number of printed textiles per time unit. In this process, pallets can be loaded with textile independently of each other.

According to the invention it is particularly preferred that in the set-up stations several pallets arranged next to each other are provided, wherein the pallets of each set-up station can each be moved independently of each other between their lateral set-up positions and the printing position. The arrangement of several pallets at each set-up station can allow for an especially space-saving provision of a plurality of the printing device units according to the invention which can each enable a particularly efficient printing of textile surfaces in the manner set out above. Especially from the point of view of a more economical utilization of manpower the provision of several pallets supported next to each other in the set-up stations, or at least in one of the set-up stations, can reduce idle times in particular. The individual movement means of the several pallets of the set-up stations arranged next to each other can be movable in parallel to each other. This makes it possible that pallets of a set-up station can be loaded with textile to be printed by a single user. In addition, it may be expedient that all pallets of both set-up stations can be printed by means of the same printing means. Thus, one printing means can be provided for printing all textiles delivered.

An advantageous further development of the method according to the invention can reside in the fact that the at least one textile and the at least one further textile are moved on their respective pallets from opposite longitudinal sides of a longitudinal axis into the printing position. Thus, textile to be printed can be delivered to the printing position from opposite sides. For this purpose, the respective pallets can be loaded with textile at their set-up stations and can subsequently be delivered to the printing position.

Moreover, according to a further development of the invention it is preferred that the movement means of the at least one pallet and the at least one further pallet are moved individually, wherein the pallets are arranged in pairs along a joint axis which differs from the longitudinal axis. Preferably, the alignment of the joint axis can be designed such that the pallets are delivered from the set-up stations to the printing position in a direction transverse to the longitudinal direction of the device of the printing position.

According to a further development of the invention it is particularly preferred that the two pallets which are moved along the joint axis are alternately located in the printing position and in their respective set-up positions. Such a method can enable the particularly efficient utilization of a joint printing position, whereby the time between individual printing cycles, i.e. the idle time at the printing position, can be reduced considerably.

Moreover, according to a further development of the invention it is preferred that pallets of the same set-up station are moved independently of each other between the corresponding set-up station and the printing position. The independent movement of pallets of the same set-up station makes it possible to load these successively with a textile and deliver them to the printing means. As a result, even a single user can operate a set-up station that has several pallets with especially little idle time, in which individual pallets remain unloaded in the set-up station.

Figure 2:
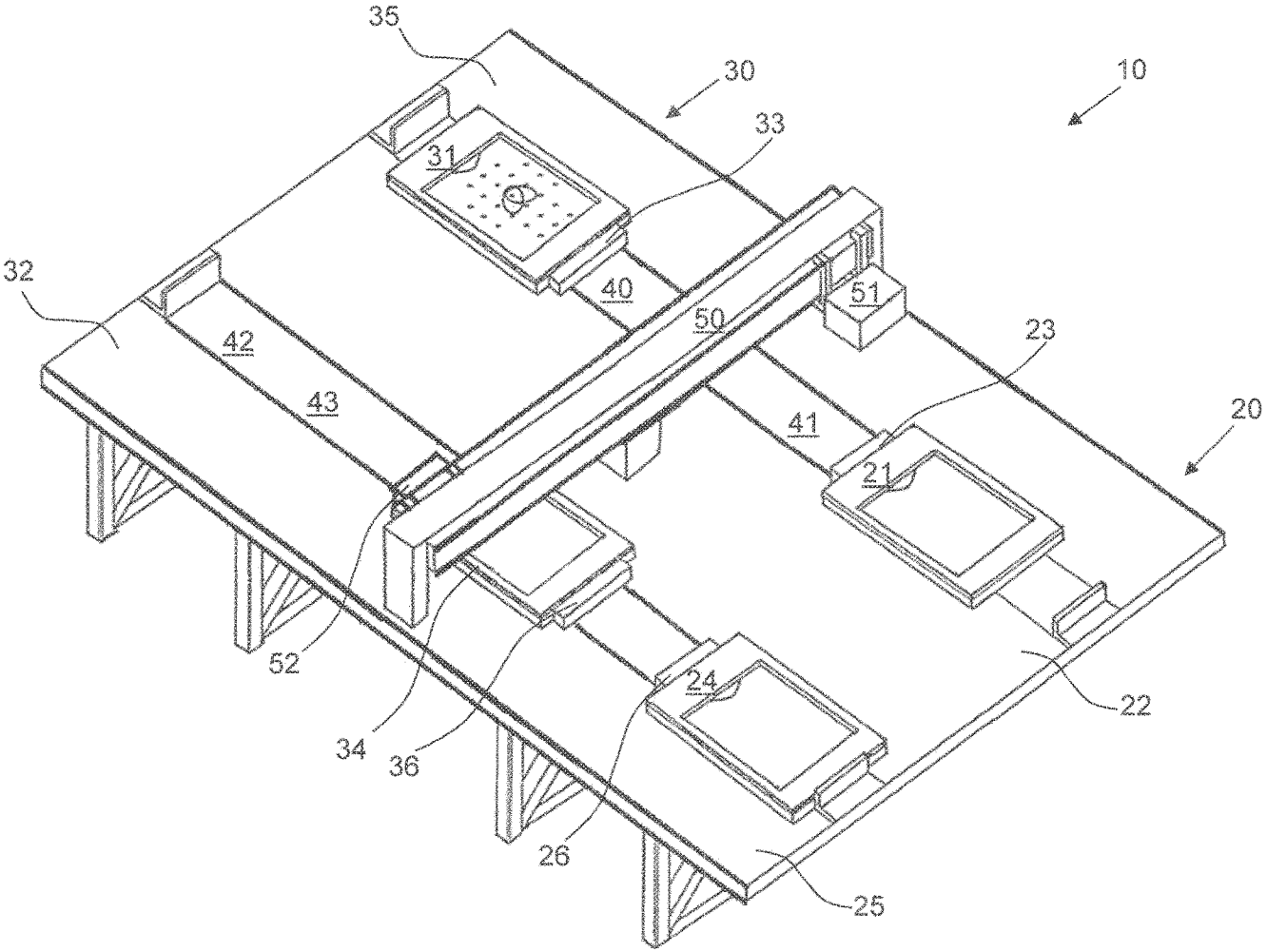
Figure 3:
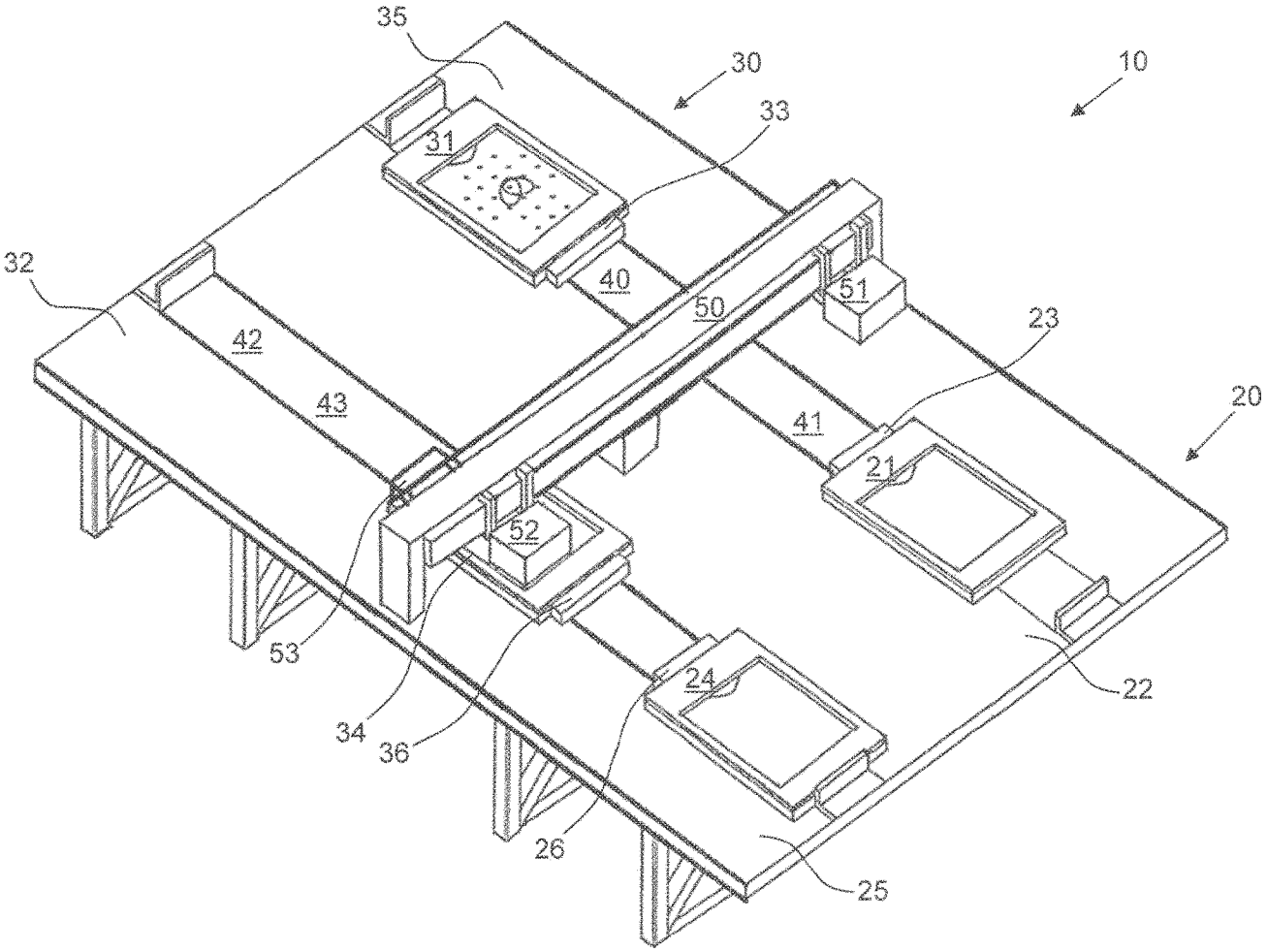

The invention will be explained further hereinafter by way of the accompanying schematic drawing, wherein shows:

FIG. 1 a schematic illustration of the device according to the invention for printing textile surfaces;

FIG. 2 a schematic illustration of the device according to the invention for printing textile surfaces pursuant to FIG. 1, with one printing means being in each case arranged on both sides of the longitudinal beam;

FIG. 3 a schematic illustration of the device according to the invention for printing textile surfaces pursuant to FIG. 1, with an additional printing means being arranged on a second side of the longitudinal beam.

FIG. 1 shows an embodiment of the device 10 according to the invention, in which two guide rails 40, 42 are arranged in parallel next to each other and transversely to a longitudinal axis along the longitudinal beam 50. These can form the tracks 41, 43, along which the respective pallets 21 and 31 as well as 24 and 34 can be arranged in a movable manner. According to the invention, provision can also be made for more than two tracks, in particular three, four, five or more, in particular having guide rails and pallets. Hence, the set-up station 20 according to FIG. 1 has two pallets 21, 24, with one of the two pallets being in each case arranged on one of the guide rails 40, 42. The pallets 21 and 24 can be moved independently of each other on their respective guide rails 40 and 42 between their set-up positions 22, 25 in the set-up station 20 and the printing position. Likewise, in the second set-up station 30 two further pallets 31, 34 are also provided according to the embodiment of FIG. 1, in which case the further pallet 31 has a printed textile that is moved between the printing position and the second set-up station 30 and the further pallet 34 is delivered to the printing means 52. According to FIG. 1 the pallet 21 is in the process of being delivered to the printing position. This can take place already at the stage when the pallet 31 has not yet reached the second set-up station 30. The same applies to pallets 24 and 34.

The pallets of the set-up station 20 or the second set-up station 30 can in particular be delivered simultaneously to their respective printing positions in the area of the longitudinal beam 50.

Along the longitudinal beam 50 one printing means 51, 52 is in each case provided for a pair of pallets that are supported on a joint rail 40, 41 (FIG. 1). The printing means 51, 52 are designed to move independently of each other in a longitudinal direction along the longitudinal beam 50. This also enables a delivery of both printing means 51, 52 to the printing position of a single pallet. Especially in the case of a simultaneous delivery of several pallets of one of the set-up stations 20, 30 the printing means 51, 52 can jointly print the several pallets. In this way, the two printing means can also print e.g. three, four, five or more pallets of the same set-up station 20, 30. As a result, an efficient utilization of the printing means 51, 52 is rendered possible.

An expedient embodiment can reside in the fact that pallet pairs of several parallel guide rails can be printed by means of a single printing means. In the manner set out above, any desired number of pallet pairs, which are in each case supported on a joint guide rail, can be provided in parallel next to each other. Concerned here can be an arrangement which basically corresponds to a multiple of the embodiment according to FIG. 1. Alternatively, such a device can be designed with only a single printing means, by means of which textiles can be printed on all pallets delivered to the printing position.

According to FIG. 1 the printing means 51, 52 are arranged on the same side of the longitudinal beam 50.

FIG. 2 shows an embodiment of the present invention, in which the printing means 51 and 52 are arranged on opposite sides of the longitudinal beam 50. Each of the printing means 51, 52 can be moved independently of the respective other printing means 51, 52 in a longitudinal direction along the longitudinal beam 50. Thus, each of the printing means is designed to assume the respective printing position on each of the tracks 41, 43 independently of the position of the further printing means and to print a textile on the respective pallet that has been delivered to the printing position of the corresponding track. Likewise, according to the embodiment pursuant to FIG. 2 several pallets 21, 24 or 31, 34 of the same set-up station 20 or 30 can be delivered simultaneously to their respective positions in the area of the longitudinal beam 50, in which case the printing means 51 and 52 are designed to jointly print the textiles on the pallets. Likewise, according to the embodiment pursuant to FIG. 2 three, four, five or more tracks with two pallets each can be arranged next to each other which, just as in FIG. 1, are arranged underneath a joint longitudinal beam 50. The two printing means 51, 52 can thus also jointly print three, four, five or more textiles on pallets delivered from the same or different set-up stations to the printing position in the area of the longitudinal beam 50.

In FIG. 3 a further embodiment of the printing device 10 according to the invention is illustrated. This differs in particular from the embodiment according to FIG. 1 in that a further printing means 53 is arranged on a second longitudinal side of the longitudinal beam 50. This is arranged such that it can be moved in an unrestricted manner along the longitudinal beam 50 across the width of the printing device 10. Just as in the embodiments according to FIG. 1 and FIG. 2, the printing means 51, 52 and 53 are designed to print one or several pallets of the same or of different tracks, in which case, also according to the embodiment pursuant to FIG. 3, several tracks, i.e. 3, 4, 5 or more tracks can be arranged in parallel to each other underneath the longitudinal beam 50.

The invention claimed is:

1. Device for printing textile surfaces, having a first printing means which can be moved along a longitudinal axis of the device in a longitudinal direction, wherein the printing means has a print head, by means of which at least one textile can be printed with at least one printing ink, at least two pallets for accommodating and holding the textile to be printed, a first set-up station which is arranged on a first longitudinal side for supplying the textile and placing it on the pallet, at least one second set-up station which is arranged on a second longitudinal side lying opposite the first longitudinal side, a first movement means, with which the at least one of the pallets can be moved on a first track in a direction transverse to the longitudinal axis between a first lateral set-up position at the first set-up station and a first printing position at the printing means, and at least one second movement means, with which at least a further one of the pallets can be moved on at least one second track in a direction transverse to the longitudinal axis between at least one second lateral set-up position at the at least second set-up station and at least one second printing position, wherein at least one second printing means is provided, wherein the first printing means and the at least second printing means can be moved independently of each other in the longitudinal direction, and at least one of the printing means can be moved to the first printing position on the first track and to the second printing position on the at least second track.

2. Device according to claim 1, wherein at least the print heads of the first printing means and the second printing means are designed to print at least both the textile on the first pallet as well as on the second pallet.

3. Device according to claim 1, wherein on the tracks one further pallet is arranged in each case, wherein one of the pallets on the respective tracks is in each case assigned to the first set-up station or the second set-up station.

4. Device according to claim 1, wherein the opposite pallets can be moved along a joint axis between their set-up positions in the respective set-up stations and the printing position.

5. Device according to claim 1, wherein one pallet of the opposite pallets can be loaded with a textile in the set-up position, while the other pallet is supported in the printing position.

6. Device according to claim 1, wherein in the set-up stations several pallets arranged next to each other are provided, wherein the pallets of each set-up station can each be moved independently of each other between their lateral set-up positions and the printing position.

7. Method for printing textile surfaces, in particular with a device according to claim 1, in which at least one textile can be accommodated and held on at least one pallet, wherein the at least one pallet is located at a first set-up station in a first lateral set-up position on a first longitudinal side, the at least one textile is moved by means of a first movement means on a first track between the first lateral set-up position at the first set-up station and a printing position at a printing means, the at least one textile is printed in the printing position by the printing means by means of at least one print head which is moved along a longitudinal axis, and by means of the first movement means the printed textile is moved from the printing position into the first lateral set-up position at the set-up station for removal, wherein at least one further textile is accommodated and held on at least one further pallet which is located in a second lateral set-up position at a second set-up station on a second longitudinal side lying opposite the first longitudinal side, the at least one further textile is moved by means of at least one second movement means on at least one second track between the second lateral set-up position at the second set-up station and the printing position at the printing means, the at least one further textile is printed in the printing position by the printing means and the at least one further textile is moved from the printing position into the second lateral set-up position at the second set-up station for removal, wherein on the tracks one further pallet is provided in each case, wherein one of the pallets on the respective tracks is in each case assigned to the first set-up station or the second set-up station, at least one second printing means is provided, wherein the first printing means and the at least second printing means are moved independently of each other in the longitudinal direction, and at least one of the printing means can be moved to the first printing position on the first track and to the second printing position on the at least second track.

8. Method according to claim 7, wherein the at least one textile and the at least one further textile are moved on their respective pallets from opposite longitudinal sides of a longitudinal axis into the printing position.

9. Method according to claim 7, wherein the movement means of the at least one pallet and the at least one further pallet are moved individually, wherein the pallets are arranged in pairs along a joint axis which differs from the longitudinal axis.

10. Method according to claim 9, wherein the two pallets which are moved along the joint axis are alternately located in the printing position and in their respective set-up positions.

11. Method according to claim 7, wherein pallets of the same set-up station are moved independently of each other between the corresponding set-up station and the printing position.

12. Method according to claim 7, wherein pallets of the same set-up station are jointly delivered from the respective set-up station to the respective printing positions.

* * * * *